United States Patent [19]

Ito

[11] 4,245,979

[45] Jan. 20, 1981

[54] APPARATUS FOR DISPOSING OF WASTE GAS BY BURNING

[75] Inventor: Takusen Ito, Osaka, Japan

[73] Assignee: Hitachi Shipbuilding & Engineering Company Limited, Osaka, Japan

[21] Appl. No.: 946,149

[22] Filed: Sep. 27, 1978

[30] Foreign Application Priority Data

Oct. 7, 1977 [JP] Japan ..... 52-135398[U]
Oct. 7, 1977 [JP] Japan ..... 52-135399[U]

[51] Int. Cl.[3] ..... F23D 13/20

[52] U.S. Cl. ..... 431/202; 431/5; 431/8; 431/114

[58] Field of Search ..... 431/5, 8, 114, 159, 431/187, 190, 202

[56] References Cited

U.S. PATENT DOCUMENTS

| | | | |
|---|---|---|---|
| 3,852,023 | 12/1974 | Itoh et al. | 431/202 |
| 3,933,420 | 1/1976 | Zink et al. | 431/202 |
| 4,065,247 | 12/1977 | Okigami et al. | 431/5 X |
| 4,084,935 | 4/1978 | Reed et al. | 431/202 |
| 4,092,095 | 5/1978 | Straitz | 431/114 |

*Primary Examiner*—Robert S. Ward, Jr.
*Attorney, Agent, or Firm*—Whittemore, Hulbert & Belknap

[57] ABSTRACT

A ground flare comprising a furnace body in the form of a tubular wall having a circular or polygonal cross section and a bottom open over the substantially entire bottom area and a multiplicity of burners arranged at the opening of the bottom of the furnace body. Each of the burners comprises a gas nozzle and a gas mixing tube having an open lower end with the upper end of the gas nozzle positioned therein and a substantially cylindrical inner surface. Most suitably for the prevention of black smoke and vibration, the gas mixing tube has an inside diameter 2 to 5 times the inside diameter of the gas nozzle and a length 5 to 10 times the inside diameter of the tube. Flame transfer plates provided between the upper ends of the gas mixing tubes serve to greatly reduce the number of pilot burners which otherwise would be needed.

7 Claims, 7 Drawing Figures

APPARATUS FOR DISPOSING OF WASTE GAS BY BURNING

The present invention relates to an apparatus for disposing of waste gas by burning (hereinafter referred to as "ground flare").

Combustible gases discharged for example from oil refineries, petrochemical plants and other plants are burned in ground flares and released to the atmosphere for disposal. The technical problem encountered with ground flares is how to treat large quantities of waste gases free of troubles such as visible flame, black smoke, noise and vibration. In other words, the level of the technique in the art is dependent on how to increase the capacity of the apparatus without entailing these troubles. Presently the occurrence of black smoke and vibration is a major factor that must be overcome for the progress of techniques in this field.

In order to solve the problems of black smoke and vibration, one skilled in the art will attempt to provide an expedient furnace body and an ingenious burner in accordance with the basic technical concept that a stabilized flame should be formed at a position which is close to the burner nozzle to the greatest possible extent. It is usually practiced to use steam to cause water gas reaction for the control of black smoke with careful consideration given to the method of injecting the steam into the apparatus so as to avoid the possible interference of the steam with the stabilization of flame.

Vibrations occurring in ground flares can be divided into two categories in accordance with the cause:

A. combustion vibration resulting from unstable flames, and

B. combustion vibration due to a local increase in the heat energy within the combustion chamber.

I have carried out various experiments on these causes and found that the cause given under A does not produce as serious an influence as the cause B contrary to what is generally thought and that an increased capacity is available with inhibited vibration if the cause B is eliminated. In eliminating the cause B, it is essential to render the temperature distribution as uniform as possible longitudinally of the furnace, namely in the vertical direction, to thereby avoid a local increase in heat energy.

U.S. Pat. Nos. 3,852,023 and 3,933,420 disclose furnaces which are so constructed that the combustion air admitted into the furnace from a lower portion thereof will form an eddy current at the bottom of the furnace in order to provide stabilized flames in the vicinity of the burner nozzle, to ensure full mixture between the gas and air and to inhibit smoking. With such furnaces, the air inlet opening is generally limited relative to the furnace bottom as disclosed in U.S. Pat. No. 3,933,420. This construction, however, has drawbacks because of too much attention given to the cause A; flames, unjustifiably stabilized, will cause combustion vibration B, with the result that the furnace has a small capacity relative to the overall furnace structure which otherwise would afford an increased capacity. Further according to U.S. Pat. No. 3,933,420, the inlet air opening at the bottom of the furnace has a limited area of 20 to 85% of the cross sectional area of the furnace for the stabilization of flames. This means that the remaining 80 to 15% area is not used effectively, indicating that the furnace has a limited capacity relative to the size of the furnace.

Burners suited for use in the apparatus disclosed include:

C. burners comprising a nozzle for injecting gas and a diffuser attached to the nozzle and serving as a stabilizer for holding a flame such that steam is forced against the flame to inhibit smoking, and D. burners substantially similar to those given under C and adapted to form a mixture of gas and steam before the gas is forced out from the nozzle.

These burners are devised primarily to afford a stabilized flame in the vicinity of the burner nozzle, so that the above-mentioned construction of the furnace and that of the burner conjointly serve to stabilize the flame in the vicinity of the burner nozzle. A pronounced exothermic reaction consequently takes place in the vicinity of the burner nozzle, resulting in a local increase of heat energy in this portion. Although the combustion vibration due to unstable flames is avoidable, the local buildup of the heat energy within the furnace will then cause vibration.

Thus ground flares involve the problem of how to treat large quantities of waste gases within the limited space of the furnace, unlike the problems experienced with boilers and heating furnaces for commercial use. For this reason, the techniques developed for boilers and heating furnaces, if applied to the ground flare as they are, will be unable to overcome the problems of black smoke, vibration, etc.

A first object of this invention is to provide a ground flare which utilizes the interior space of the furnace 100%.

To fulfil this object, the invention provides a ground flare including a furnace body in the form of a tubular wall having a bottom which is open substantially over the entire bottom area.

A second object of this invention is to provide a ground flare including a furnace in which localized occurrence of thermal energy is prevented and which is free of vibration.

To fulfil this object, the present invention provides a ground flare including gas burners each comprising a gas nozzle and a gas mixing tube having an open lower end with the upper end of the gas nozzle positioned therein and a substantially cylindrical inner surface, so that the nozzle will provide a flame which is not stable in the vicinity of the nozzle but is positioned as somewhat lifted therefrom.

In order to fully achieve the foregoing objects and to inhibit black smoke, the gas mixing tube in accordance with a preferred embodiment of the invention has an inside diameter D which is defined by $D=2d$ to $5d$ wherein d is the inside diameter of the gas nozzle, the gas mixing tube having a length L defined by $L=5D$ to $10D$.

Further according to the preferred embodiment of this invention, the gas mixing tube has at its lower end a conical inner surface continuous with the cylindrical inner surface and having an increasing diameter toward the lower end extremity so that air can be drawn into the tube with the smallest possible resistance.

Another object of this invention is to provide a ground flare in which the number of pilot burners required for ignition in like conventional apparatus has been greatly reduced while ensuring that all the burners can be ignited reliably.

To this end, the gas mixing tubes are provided, according to another preferred embodiment of the invention, with flame transfer plates interconnecting the tubes so as to minimize the number of pilot burners which must be kept burning at all times to dispose of the gas emergently released, whereby the quantity of the gas to be otherwise wasted is reduced.

Various other features and advantages of the present invention will be easily understood from the description of the preferred embodiments given below with reference to the accompanying drawings, in which.

Figure 1:
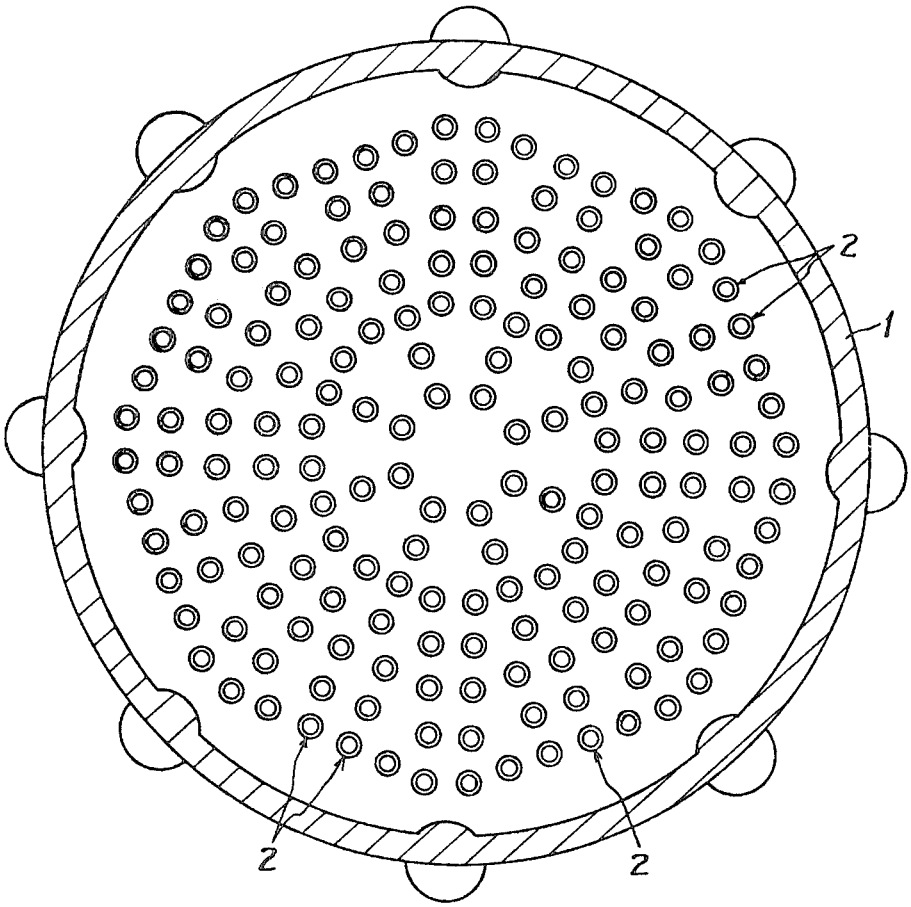
FIG. 1 is a plan view showing a first embodiment of the invention.
Figure 3:
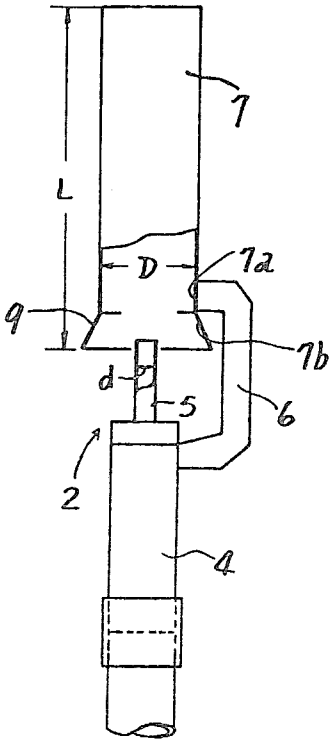
FIG. 3 is a front view partly broken away and showing a burner in detail.
Figure 2:
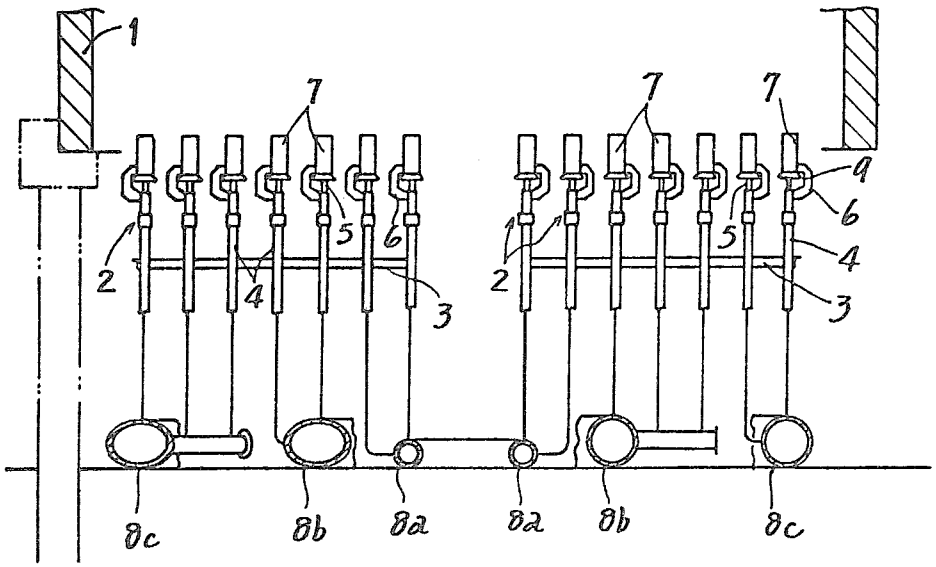
FIG. 2 is a front view in vertical section showing the same.

With reference to FIGS. 1 to 3, a tubular furnace body 1 has a bottom which is fully open, namely 100% open. A plurality of gas burners 2 are arranged at the opening. Each of the gas burners 2 comprises a gas supply pipe 4 supported by a frame 3, a gas nozzle 5 mounted on the upper end of the supply pipe 4, and a gas mixing tube 7 having a lower end in which the upper end of the gas nozzle 5 is positioned. The gas mixing tube 7 is supported by an arm 6 on the gas supply pipe 4. The supply pipes 4 are suitably connected to a plurality of gas headers 8*a*, 8*b* and 8*c*.

In the burner 2, the relation between the inside diameter D of the gas mixing tube 7 and the inside diameter d of the gas nozzle 5 is defined by $D=2d$ to $5d$, and the relation between the inside diameter D and the length L of the gas mixing tube 7 is defined by $L=5D$ to $10D$.

The gas mixing tube 7 is provided at its lower end with a conical tube portion 9 as is best shown in FIG. 3. The tube portion 9 has a conical inner surface 7*b* continuous with the cylindrical inner surface 7*a* of the tube 7 and having an increasing diameter toward the lower end extremity. This renders air drawable into the mixing tube 7 with reduced resistance.

The gas burner 2 is similar to known burners in that the force of the waste gas injected draws primary combustion air into the burner but distinctly differs therefrom in that the gas mixing tube 7 is not a diffuser and has a substantially tubular inner surface. Thus the burner 2 forms a flame which is not stable in the vicinity of the nozzle but is positioned as slightly lifted from the nozzle. In such a lifted position, the flame should not be extinguished by being blown off the burner. It is further required that air be introduced into the mixing tube 7 at a sufficient rate to avoid formation of black smoke. The gas burner 2, which has the dimensions as defined above, fulfils these requirements. When the burner 2 is so dimensioned, the amount of primary air available inhibits smoking, and the flame is formed as somewhat lifted from the burner without the likelihood of being blown off. While thus preventing smoking, the structure of the burner described reduces local increase of thermal energy, consequently inhibiting vibration. The amount of air is 2 to 5 in terms of air/gas ratio.

Because the ratio of area of the open furnace bottom, namely of the air inlet, to the cross sectional area of the furnace body is substantially 100%, the apparatus has a capacity which utilizes the interior space of the furnace body 100%.

A second embodiment will be described with reference to FIGS. 4 to 7.

This embodiment is an improvement over the first embodiment shown in FIGS. 1 to 3. Although not shown in FIGS. 1 to 3 and not described, the gas burners described each have a pilot burner, and all the pilot burners are kept burning at all times to dispose of the gas emergently released, because if a reduced number of pilot burners are used, for example one pilot burner for every three gas burners, all the gas burners will not be ignited in the event waste gas should be abruptly released from a safety valve, with the resulting likelihood that the unburned gas will cause an explosion accident. In the case where a pilot burner is provided for each gas burner, the amount of gas used will amount to as much as 300,000 $Nm^3$ per year, hence prohibitively costly. With the second embodiment, the number of the pilot burners is greatly reduced, whereas the arrangement assures reliable ignition. Substantially the same components as those of first embodiment will not be described and are referred to like reference numerals.

Figure 4:
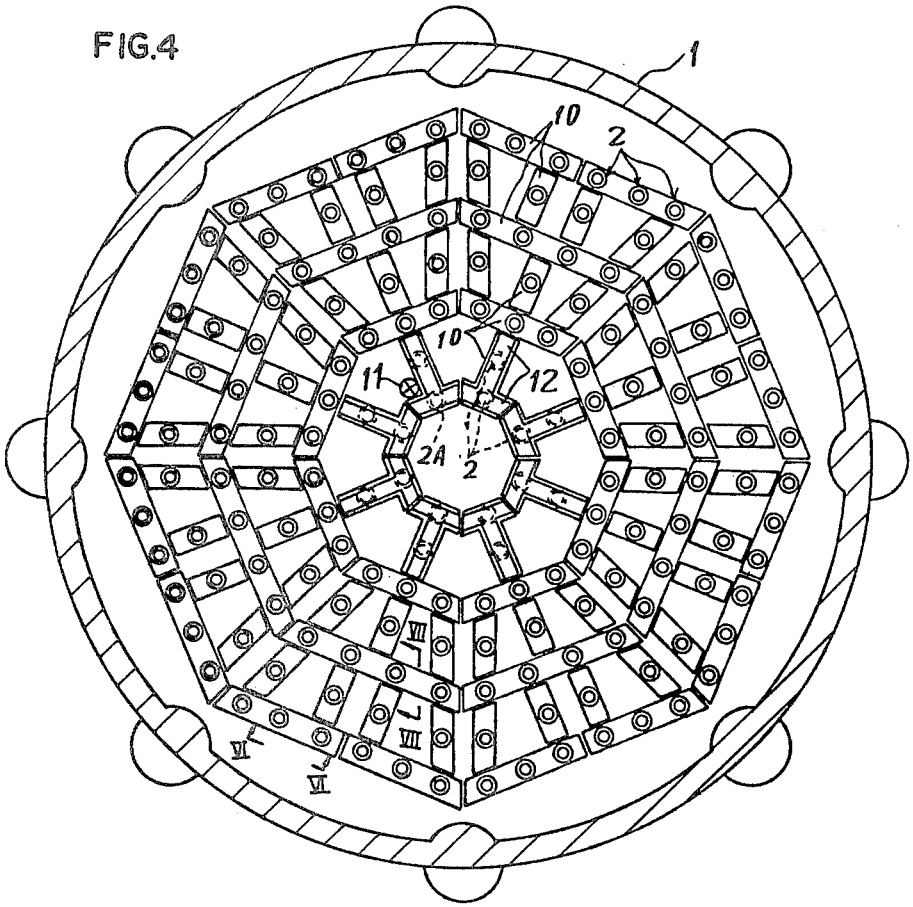
FIG. 4 is a plan view of a second embodiment of the invention.
Figure 5:
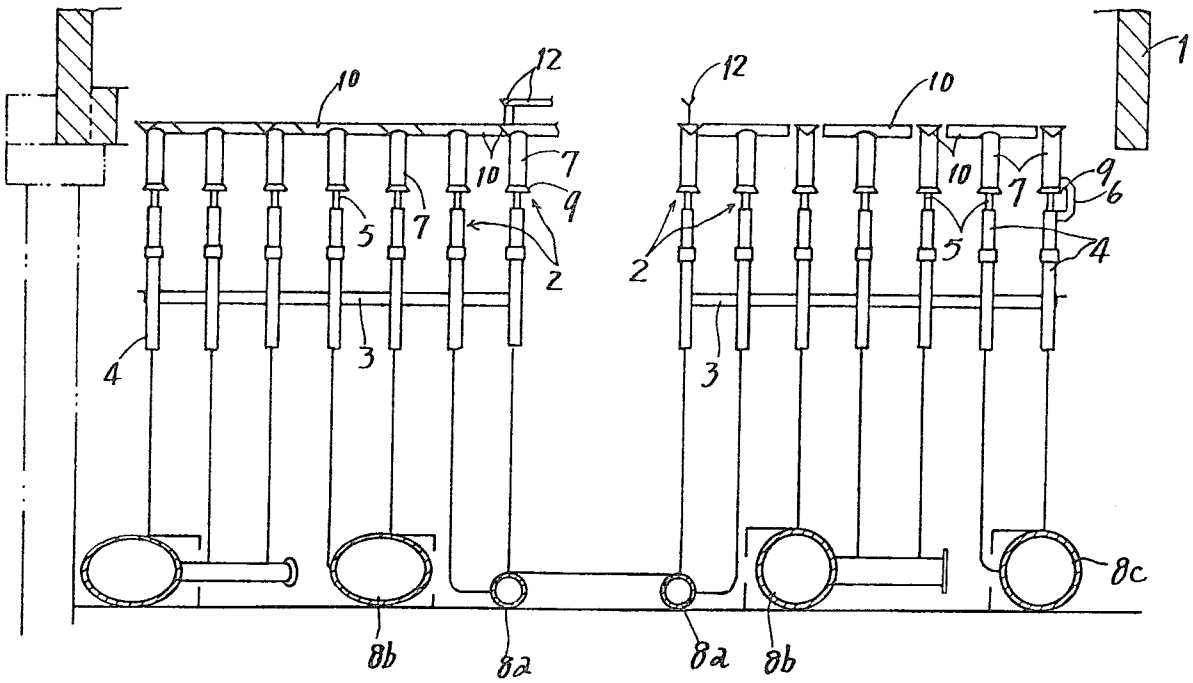
FIG. 5 is a front view in vertical section showing the same.

With reference to FIGS. 4 and 5, flame transfer plates 10 interconnect the upper ends of gas burners 2 adjacent to one another, namely upper ends of gas mixing tubes 7. With this embodiment, the plate 10 is in the form of a plate V-shaped in cross section. The flame transfer plate is attached to the mixing tube 7 with the upper end of the tube 7 extending through the plate. The plates 10 are divided into a plurality of pieces both radially and circumferentially of the furnace so as to facilitate local replacement of the gas burners 2. A pilot burner 11 is disposed beside only one desired gas burner 2A among the multiplicity of burners 2. The pilot burner 11 must be so positioned as to ensure rapid transfer of flame. The order in which the gas burners 2 are operated to release the gas needs also be considered.

The gas released from the gas burners 2 is ignited first at the burner 2A which is equipped with the pilot burner 11. Part of the resulting flame is forced against the flame transfer plates 10 by an eddy current over the plates 10 produced by the draft within the furnace body, with the result that the flame extends to adjacent gas burners 2, igniting the burners. In this way burners are ignited in succession, and the fire spreads to all the burners 2 in the ground flare. This usually takes 5 seconds or less. Thus the spread of the fire is nearly as quick as when all the gas burners are each equipped with a pilot burner. The embodiment does not involve the danger of explosion due to ignition failure.

The position, size and shape of the flame transfer plates 10 are very critical because these factors are closely related to smoking and vibration. For example, when the flame transfer plates 10 are arranged above the gas mixing tubes 7, a higher fire spreading speed results but an increased amount of heat energy is produced locally in the lower portion of the furnace 1, possibly giving rise to combustion vibration. Additionally, the flame transfer plates 10 are likely to cool the flame zone, permitting the formation of black smoke. The size of the flame to be transferred, which is proportional to the width of the transfer plates, may be as small as possible provided that the flame, when forced against the plate, can spread to an adjacent burner. Larger flames will cause smoking and vibration.

Figure 6:
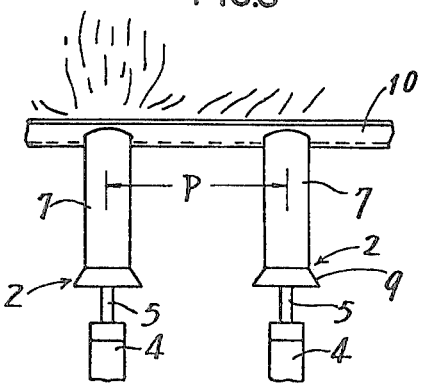
FIG. 6 is an enlarged view taken along the line VI—VI in FIG. 4 and showing the burner and a flame transfer plate in detail.
Figure 7:
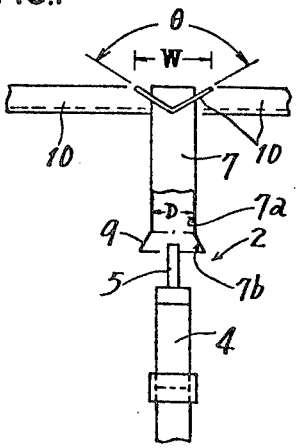
FIG. 7 is an enlarged view similar to FIG. 6 and taken along the line VII—VII in FIG. 4

In view of the above, an example of useful transfer plates will be described with reference to FIGS. 6 and 7. The plate 10 is attached to the top end of the gas mixing tube 7. It is assumed that the gas burners 2 are arranged at a pitch P, and that the gas mixing tube has an inside diameter D. When P=5D to 10D, the width W of the flame transfer plate 10 is given by W=1D to 1.2D. The V-shaped plate 10 has a bevel angle $\theta$ of 90° to 180°. The plate thus dimensioned assures efficient transfer of flame and satisfactory combustion free of black smoke or vibration.

Even when one pilot burner is provided for one ground flare, the provison of the flame transfer plates permits rapid and reliable ignition. As a result, the fuel cost for pilot burners can be greatly reduced to about 1/20 of the cost usually required.

Further as seen in FIGS. 4 and 5, the flame transfer plates 10 positioned in the center of the furnace are provided with auxiliary flame transfer plates 12 a suitable distance above the plates 10 when so desired. In case gases of low combustibility are burned, flames tend to lift to a higher level, so that there is the likelihood that the flame transfer plates 10 alone may possibly be unable to ensure ignition of adjacent burners 2. Thus even when a waste gas of reduced combustibility is fed to the gas burners, the auxiliary plates 12 assure reliable ignition of neighboring gas burners 2. When it is apparent that highly combustible gases alone will be fed to the apparatus, the auxiliary flame transfer plates 12 can be dispensed with.

What is claimed is:

1. An apparatus for disposing of waste gas by burning comprising:

a furnace body in the form of a tubular wall having a vertical axis and having a bottom open over the substantially entire bottom area, a multiplicity of burners arranged at the opening of the bottom of the furnace body and each comprising a gas nozzle and a gas mixing tube having an open lower end with the upper end of the gas nozzle positioned therein and a substantially cylindrical inner surface, said gas mixing tubes being provided with flame transfer plates interconnecting the upper ends of tubes adjacent to one another, a pilot burner disposed beside at least one of the burners, and means for feeding the waste gas to the nozzles.

2. An apparatus as defined in claim 1 wherein the relation between the inside diameter D of the gas mixing tube and the inside diameter d of the gas nozzle is defined by D=2*d* to 5*d*, and the relation between the inside diameter D of the gas mixing tube and the length L of the tube is defined by L=5D to 10D.

3. An apparatus as defined in claim 1 wherein the gas mixing tube has at its lower end a conical inner surface continuous with the cylindrical inner surface and having an increasing diameter toward the lower end extremity.

4. An apparatus as defined in claim 1 wherein the burners are arranged at a pitch P is defined by P=5D to 10D wherein D is the inside diameter of the gas mixing tube.

5. An apparatus as defined in claim 1 or 4 wherein the flame transfer plate has a width W defined by W=1D to 1.2D wherein D is the inside diameter of the gas mixing tube.

6. An apparatus as defined in claim 1 wherein the flame transfer plate is V-shaped in cross section and has a bevel angle of at least 90°.

7. An apparatus as defined in claim 1 wherein the flame transfer plates positioned in the center of the furnace are provided with auxiliary flame transfer plates positioned a suitable distance above the flame transfer plates.

* * * * *